US008708255B2

(12) United States Patent
Steffens

(10) Patent No.: US 8,708,255 B2
(45) Date of Patent: Apr. 29, 2014

(54) SHOWER ATTACHMENT HAVING A JOINT

(75) Inventor: Guido Steffens, Freudenstadt (DE)

(73) Assignee: Hansgrohe SE, Schiltach (DE)

( * ) Notice: Subject to any disclaimer, the term of this patent is extended or adjusted under 35 U.S.C. 154(b) by 78 days.

(21) Appl. No.: 13/214,849

(22) Filed: Aug. 22, 2011

(65) Prior Publication Data

US 2012/0048969 A1 Mar. 1, 2012

(30) Foreign Application Priority Data

Aug. 24, 2010 (DE) ..... 10 2010 039 679

(51) Int. Cl.

| | |
|---|---|
| ***B05B 1/30*** | (2006.01) |
| ***A62C 31/00*** | (2006.01) |
| ***B05B 1/14*** | (2006.01) |
| ***B05B 1/00*** | (2006.01) |

(52) U.S. Cl.

USPC ..... 239/579; 239/436; 239/443; 239/556; 239/557; 239/558; 239/597

(58) Field of Classification Search

USPC ..... 239/436, 443, 447, 556–558, 239/581.1–581.6, 597, 587.1, 393, 395, 239/397, 579

See application file for complete search history.

(56) References Cited

U.S. PATENT DOCUMENTS

| | | | | |
|---|---|---|---|---|
| 3,524,591 | A * | 8/1970 | Samuels et al. | 239/428.5 |
| 4,131,233 | A * | 12/1978 | Koenig | 239/381 |
| 5,100,055 | A * | 3/1992 | Rokitenetz et al. | 239/11 |
| 5,184,777 | A * | 2/1993 | Magnenat et al. | 239/447 |
| 5,215,258 | A * | 6/1993 | Jursich | 239/394 |
| 5,356,077 | A * | 10/1994 | Shames et al. | 239/383 |
| 5,356,078 | A * | 10/1994 | Bischoff | 239/447 |
| 5,383,604 | A * | 1/1995 | Boesch | 239/447 |
| 5,397,064 | A * | 3/1995 | Heitzman | 239/99 |
| 5,476,224 | A | 12/1995 | Chan | |
| 5,476,225 | A | 12/1995 | Chan | |
| 5,690,282 | A | 11/1997 | Guo | |
| 5,765,760 | A * | 6/1998 | Kuo | 239/440 |
| 5,860,599 | A * | 1/1999 | Lin | 239/443 |
| 5,918,816 | A * | 7/1999 | Huber | 239/391 |
| 6,076,743 | A * | 6/2000 | Fan | 239/99 |

(Continued)

FOREIGN PATENT DOCUMENTS

| | | | |
|---|---|---|---|
| DE | 4118540 | A1 | 12/1992 |
| DE | 19501313 | A1 | 7/1996 |
| DE | 212007000025 | U1 | 8/2007 |
| EP | 1759770 | A1 | 3/2007 |

OTHER PUBLICATIONS

EPO Recherchenbericht, EP 11177390, Nov. 16, 2011.

*Primary Examiner* — Len Tran
*Assistant Examiner* — Alexander M Valvis
(74) *Attorney, Agent, or Firm* — Duane Morris LLP

(57) ABSTRACT

A shower attachment which can be adjusted about a joint is proposed. The shower attachment comprises in one shower-attachment housing two water guides with in each case one outlet option. A changeover device can be used to change over between the two water guides. The changeover device comprises a valve having a valve closing body. In order to actuate the changeover device, an actuating element is provided on the shower-attachment housing and can be adjusted in two opposite directions relative to the shower-attachment housing. The two adjusting directions of the actuating element are at the same time directions which lead to a pivoting of the shower attachment about the joint axis.

13 Claims, 3 Drawing Sheets

(56) References Cited

U.S. PATENT DOCUMENTS

| | | | | |
|---|---|---|---|---|
| 6,276,614 | B1 * | 8/2001 | Huang | 239/383 |
| 6,343,750 | B1 * | 2/2002 | Engel | 239/463 |
| 6,360,965 | B1 * | 3/2002 | Clearman et al. | 239/222.19 |
| 6,367,710 | B2 * | 4/2002 | Fan | 239/99 |
| 6,607,148 | B1 * | 8/2003 | Marsh et al. | 239/447 |
| 6,641,057 | B2 * | 11/2003 | Thomas et al. | 239/104 |
| 7,100,845 | B1 * | 9/2006 | Hsieh | 239/447 |
| 7,229,031 | B2 * | 6/2007 | Schmidt | 239/587.3 |
| 7,503,345 | B2 * | 3/2009 | Paterson et al. | 137/625.47 |
| 7,594,617 | B2 * | 9/2009 | Kaess et al. | 239/579 |
| 7,770,820 | B2 * | 8/2010 | Clearman et al. | 239/222.11 |
| 7,832,662 | B2 * | 11/2010 | Gallo | 239/587.1 |
| 7,896,259 | B2 * | 3/2011 | Meisner et al. | 239/383 |
| 7,992,807 | B2 * | 8/2011 | Pan | 239/449 |
| 8,056,836 | B2 * | 11/2011 | Chen et al. | 239/587.5 |
| 8,132,745 | B2 * | 3/2012 | Leber et al. | 239/447 |
| 2004/0251325 | A1 * | 12/2004 | Schmidt | 239/587.3 |
| 2005/0205697 | A1 * | 9/2005 | Lo | 239/592 |
| 2008/0217434 | A1 | 9/2008 | Kaess et al. | |
| 2009/0200401 | A1 * | 8/2009 | Esche et al. | 239/525 |

* cited by examiner

SHOWER ATTACHMENT HAVING A JOINT

The invention relates to a shower attachment having a shower-attachment housing which is fastened by means of a joint so that the shower-attachment housing can be adjusted. An example of such a shower attachment is an overhead shower attachment which is fastened by means of a joint to a tube projecting out of the wall. The shower-attachment housing can then be adjusted in order to be adapted to the respective user.

Both for overhead shower attachments and for hand-held shower attachments, it is known to provide a changeover device, which can be actuated by means of an actuating element, in order to change the jet characteristics or other properties. For example, the hardness of the jet emerging from a shower attachment can be adjusted, for which purpose rotatable toggles on the side of the shower-attachment housing or annular elements that surround the spray disc can be provided. It is likewise known to switch between a hard massage jet and a soft aerated jet.

It is also already known to provide a shower attachment with two different jet outlets and to switch between these jet outlets by tilting the shower-attachment housing itself (EP 1759770 A1).

The invention is based on the object of configuring a shower-attachment fitted by way of a joint in such a way that it can be operated in a particularly practical and ergonomic manner.

In order to achieve this object, the invention proposes a shower attachment having the features mentioned in Claim 1. Developments of the invention are the subject matter of dependent claims.

In this way, a user can actuate the changeover device with the same hand movement which he uses to adjust the shower attachment. In the process he can either only actuate the changeover device or only change the direction of the shower-attachment housing with respect to the part to which the shower-attachment housing is fitted by means of the joint or do both at the same time.

The invention is of great interest particularly when a specific position of the shower-attachment housing can be assigned to a particular type of water jet to be emitted.

As a development of the invention, it can be provided that the force which a user has to apply in order to actuate the changeover device is smaller than the force which he requires for adjusting the shower-attachment housing.

As a result, the user can also actuate the changeover device without carrying out an adjustment and does not have to specially hold on to the shower-attachment housing for this purpose.

In a further development of the invention, it can be provided that the actuating element is fitted to and mounted on the shower-attachment housing such that it can be moved in two opposite directions. In order to change over from one option to the other option, the actuating element is therefore actuated in one direction and is then actuated in the other direction in order to change back over. The two directions are opposite to one another since with the same kind of movement the shower-attachment housing can also be adjusted.

According to the invention, it can be provided that the actuating element and/or the changeover device is designed such that the actuating element remains in the position it has assumed. Optionally, this can also be achieved or supported by a catch. This catch can act both on the actuating element and on the changeover device itself, optionally on both.

In a development of the invention, it can also be provided that the actuating element and/or the changeover device is designed such that the actuating element returns to a specific start position, optionally with a time delay or on account of other circumstances. Consideration should also be given here to the fact that, in a similar manner to a hand-held shower attachment, the changeover device is configured such that once the flow of water has been switched off the changeover device returns to a specific position of the shower attachment.

It is likewise possible, and is proposed by the invention, for there to be provided two actuating elements, each of which serves to switch the changeover device into a specific position.

It has been mentioned that the changeover device is provided to switch the shower attachment between two options. These can be, for example, two different types of jet, for example a hard massage jet and a soft aerated jet. These two types of jet can optionally also emerge from the same location on the shower-attachment housing. Another option would be for switching to take place between two different jet outlets from the shower-attachment housing. These can be two different outlets at two different locations on the shower-attachment housing. The shape of the outlet can also differ.

In a further development of the invention, it can be provided that the actuating element is a pushbutton which is perfectly suited to a specific actuation direction.

According to the invention, it can be provided that at least one actuating element is arranged in the region of the front side, facing the user, of the shower-attachment housing. This is also the location on which a user would normally act to change the direction of the shower-attachment housing.

The joint about which the shower-attachment housing can be adjusted can be for example a ball joint.

It is likewise possible for the joint to be a rotary joint with a fixed axis of rotation.

Further features, details and advantages of the invention can be gathered from the claims and the abstract, the wording of both of which is included in the description by reference, from the following description of preferred embodiments of the invention and on the basis of the drawing, in which:

Figure 1:
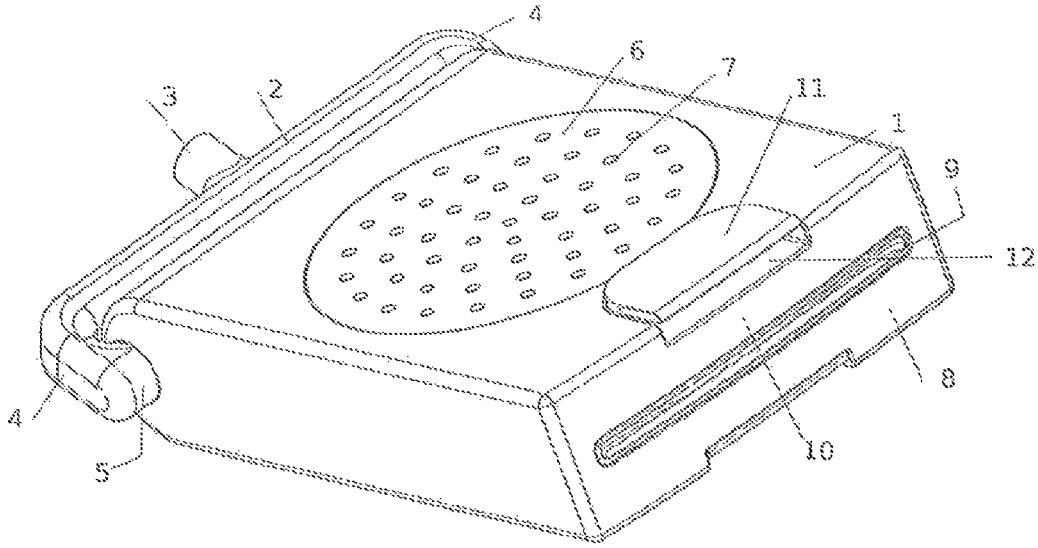
FIG. 1 shows a perspective view from below of a shower attachment according to the invention.

The shower attachment illustrated in FIG. 1 contains a shower-attachment housing 1, which in the example illustrated has the form of a cuboid. A junction 2, which has a connection stub 3, is connected to a line which is not illustrated. The substantially rectilinear junction 2 has at its two ends a respective arm 4 which projects into the interior of the shower-attachment housing 1 by way of an inwardly directed attachment 5. This attachment 5 forms, together with the opening into which it projects, a pivot joint, since the shower-attachment housing 1 can be pivoted about the axis running through the middle of the attachments 5.

Arranged on the underside, illustrated at the top in FIG. 1, of the shower-attachment housing is a spray disc 6, which has a multiplicity of jet-outlet openings 7.

Formed on the front end side 8, which projects away from the connection stub 3, of the shower-attachment housing 1 is a slot-like opening 9, the longitudinal axis of which runs parallel to the junction 2. This opening 9, too, forms a jet-outlet opening.

Figure 2:
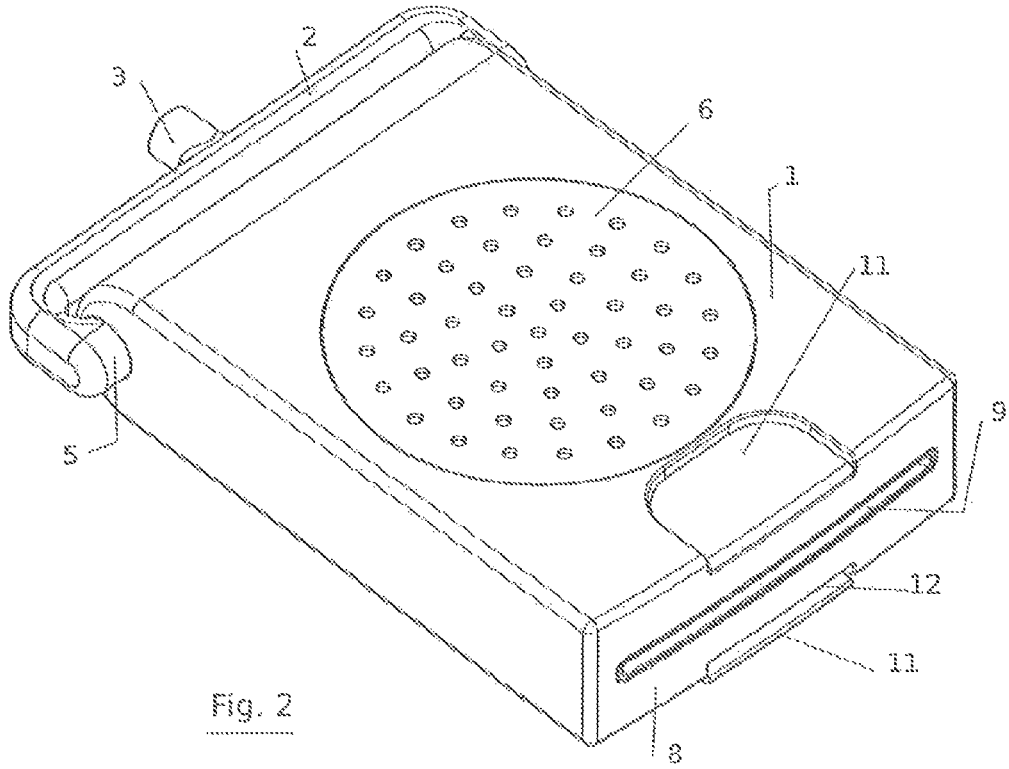
FIG. 2 shows the view of the shower attachment in an adjusted state.

Accommodated in the shower-attachment housing 1 is a changeover device, which directs the water entering the housing 1 through the connection stub 3 and the junction 2 either to the spray disc 6 or to the jet-outlet opening of the opening 9. Usually, the spray disc 6 is directed downwardly on the underside of the housing, and so the illustration in FIGS. 1 and 2 has been selected only for reasons of clearer illustration. The difference between the two positions in FIGS. 1 and 2 is that in the position in FIG. 2 the shower-attachment housing 1 has been pivoted through a particular angle about the axis of the pivot joint.

Mounted in a displaceable manner in the shower-attachment housing 1 is an actuating element 10, which is in the form of a pushbutton 11 both on the underside, which can be seen in FIG. 1, and on the opposite top side of the housing 1. The pushbutton 11 is in the form of a flat plate and corresponds in shape and size to a recess 12 in the underside of the housing 1. From the position which can be seen in FIG. 1, the actuating element 10 can be displaced downwards with respect to the housing 1 by the pushbutton 11 being pressed, as a result of which the pushbutton 11 is then located in the recess 12 while the pushbutton 11 on the opposite side of the shower-attachment housing 1 is pushed out of the corresponding recess 12. The two pushbuttons are thus part of a single actuating element.

In order to pivot the shower-attachment housing 1, a user can act either directly on the housing 1 or else on the pushbutton 11. If he presses the pushbutton 11 for example out of the position in FIG. 1, first of all the changeover device is actuated and then, when the pushbutton 11 is resting on the bottom of the recess 12, the housing 1 is pivoted. The same applies in the opposite direction.

Figure 3:
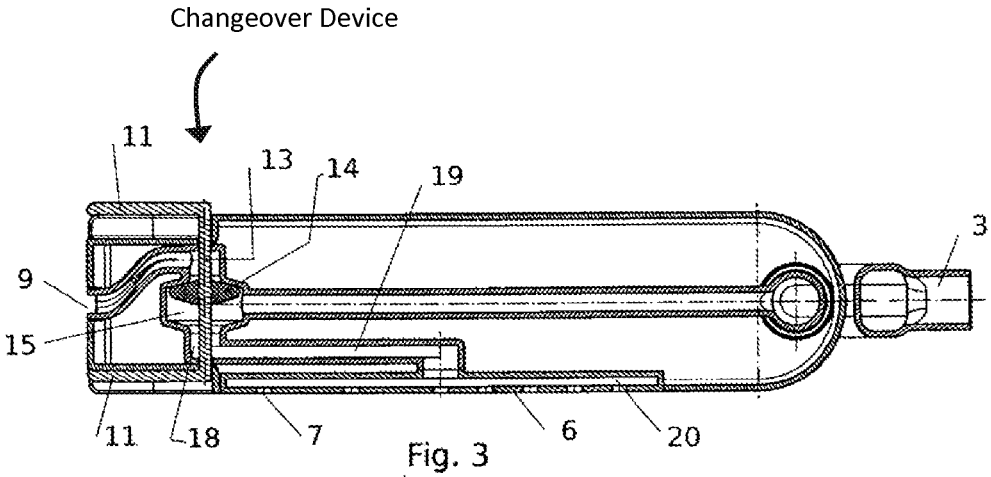
FIG. 3 shows a section through the shower attachment from FIG. 1 and FIG. 2.
Figure 4:
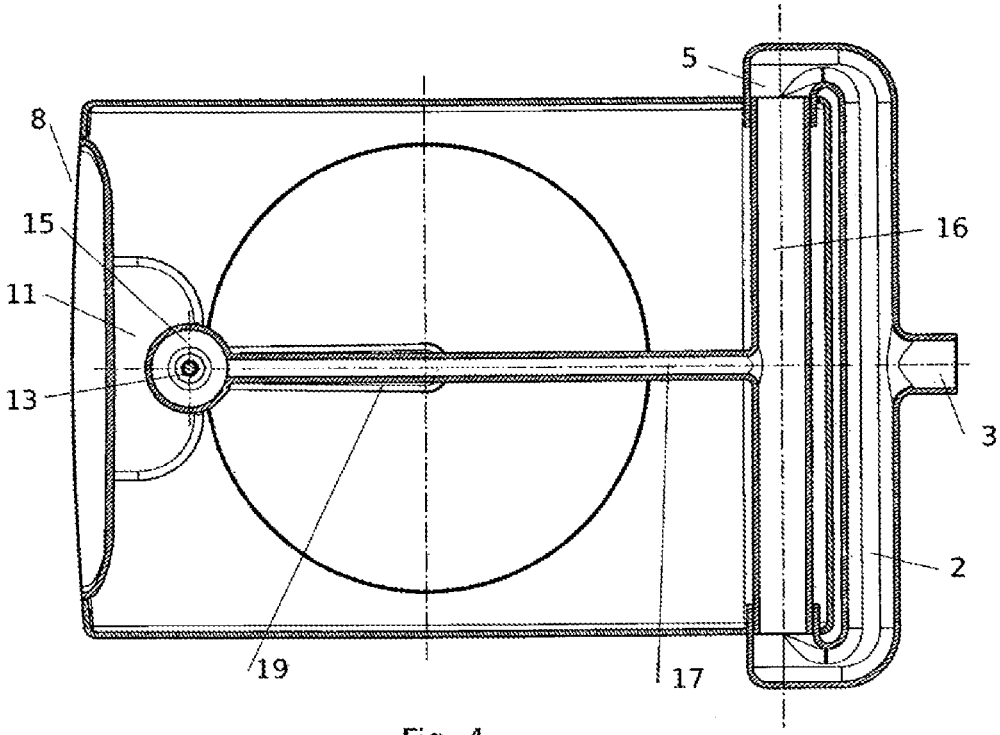
FIG. 4 shows a horizontal section through the shower attachment.

Details about switching can be gathered from the section shown in FIG. 3. The two pushbuttons 11 of the actuating element 10 are connected together by a crosspiece 13 that connects them. This crosspiece 13 also serves to guide the actuating element 10 in the housing. A valve closing body 14 in the form of a discus-shaped disc is attached to the crosspiece 13 approximately in the middle between the two pushbuttons 11. The valve closing body 14 is arranged in a valve chamber 15 which forms an upper and lower valve seat. In the position illustrated in FIG. 3, the actuating element 10 has been displaced so far that the valve closing body 14 rests against the upper valve seat of the valve chamber and closes the valve there.

The water passes out of the connection stub 3, through the junction 2 and the lateral attachments 5 and into a tube 16 passing through the shower-attachment housing. The tube 16 has a central branch 17 which is likewise approximately tubular. This tubular branch 17 leads approximately radially into the valve chamber 15. The water can flow out of the valve chamber 15 axially upwards or downwards in FIG. 3, depending on the position of the valve closing body 14. The lower outlet 18 out of the valve chamber 15 leads via a water guide 19 into a flat space 20 directly behind the spray disc 6 having the jet outlet openings 7. In the illustrated position of the actuating element 10, the water thus flows downwardly in FIG. 3 through the spray disc 6.

Figure 5:
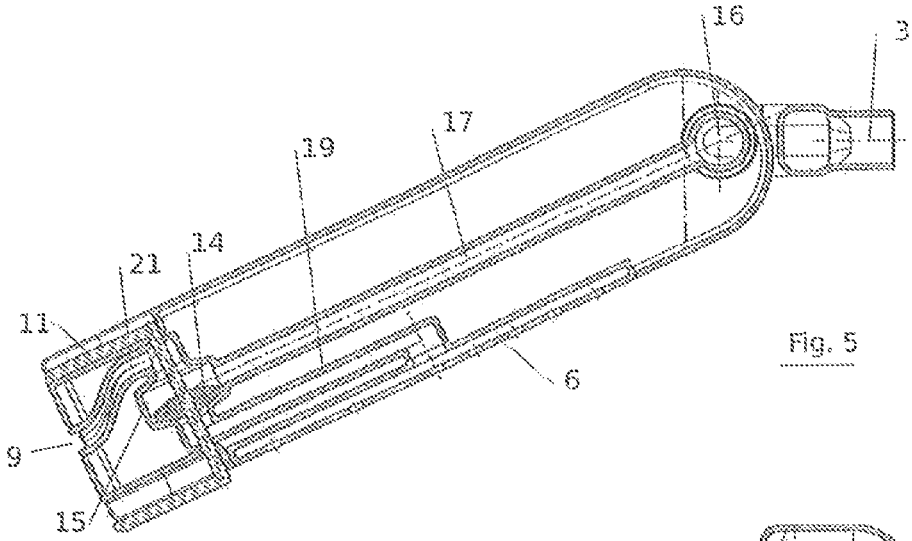
FIG. 5 shows a section corresponding to FIG. 3 with the shower attachment in a pivoted-down position.

If the actuating element 10 is pushed downwards out of the position illustrated in FIG. 3, then first of all the actuating element 10 is displaced with respect to the shower-attachment housing 1 and if pressure is continued to be applied, the shower-attachment housing 1 pivots with respect to the connection stub 3. This position is illustrated in FIG. 5. Thus, both the changeover device has been actuated and pivoting has been carried out in one manipulation here. The valve closing body 14 now rests against the lower valve seat of the valve chamber 15 and closes the water guide 19 to the spray disc 6. At the same time, the upper axial outlet out of the valve chamber 15 is opened, said outlet being connected via a water guide 21 to the slot opening 9. The water now emerges from the slot 9.

Figure 6:
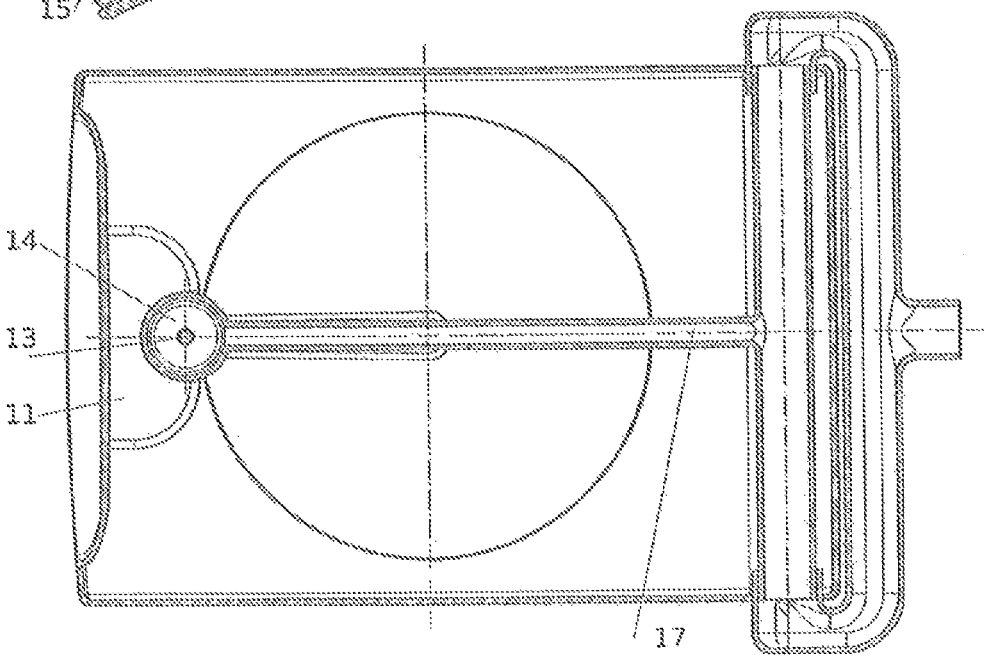
FIG. 6 shows a section, corresponding to FIG. 4, through the shower attachment in the position of FIG. 5.

The section in FIG. 6 now shows the valve closing body 14 in the valve chamber, since the valve closing body 14 is now located beneath the sectional plane in FIG. 6.

The arrangement of the various options for the outlet of the water out of the shower-attachment housing is selected such that there is a certain logic to both the pivoting and to the operation of the actuating device. In the pivoted-down position, see FIG. 5, the water emerges from the end face 8. In the pivoted-up position, see FIG. 3, the water emerges downwardly out of the spray disc 6. The outlet option which is correct in each case is established automatically by pivoting by the actuating element 10 being acted on. It would make little sense to allow the water to emerge freely out of the end face into a space in the pivoted-up position and to direct the water for example against the rear wall of a shower cabinet in the pivoted-down position.

Nevertheless, it is also possible here, if this is desired for any reason, to carry out switching independently of pivoting and to carry out pivoting independently of switching.

The embodiment illustrated is a shower-attachment having a pivot joint with a defined axis. The actuating direction of the actuating element is at the same time the direction in which a force is exerted if it is desired to pivot the shower-attachment housing. The actuating element is spaced apart from the pivot axis. It is arranged in the region of the front side, facing the user, of the shower-attachment housing.

The force that a user requires to change over the changeover device is smaller than the force which he requires to pivot the shower-attachment housing 1. The joint, which is formed by the attachments 5 and corresponding gaps in the shower-attachment housing 1, exhibits of course self-locking, in order that the housing remains in the position it has assumed.

The invention claimed is:

1. A shower attachment, comprising:

a shower-attachment housing which can be moved in an adjusting direction on a joint to adjust a water flow direction of water emerging from the shower attachment, a changeover device for changing over the water flow in the shower-attachment housing between at least two different options, at least one changeover-device actuating element coupled to the changeover device, wherein the changeover-device actuating element is arranged on the shower-attachment housing and is movable with respect to the shower-attachment housing, wherein the changeover-device actuating element has an actuating direction that coincides with movement of the shower-attachment housing in the adjusting direction on the joint, wherein the changeover device is operated by the changeover-device actuating element to change over the water flow between two shower-attachment spray outlets from the shower-attachment housing, and wherein the two shower-attachment spray outlets aim at two different directions from the shower-attachment housing, wherein movement of the shower attachment housing via the changeover-device actuating element, in an actuating direction that is a same direction as said adjusting direction of the shower-attachment housing on the joint, changes over the water flow to the one of the two shower-attachment spray outlets that is moved in said adjusting direction toward the water flow direction.

2. The shower attachment according to claim 1, wherein an actuating force required to actuate the changeover device is smaller than an adjusting force for adjusting the direction of the shower-attachment housing relative to the joint.

3. The shower attachment according to claim 1, wherein the actuating element is movable in two opposite directions in order to change over between two options in which the water flow emerges from one of the two spray outlets at one of two different locations on the shower attachment-housing.

4. The shower attachment according to claim 3, wherein at least one of the actuating element and the changeover device is designed such that the actuating element remains in a position assumed when changing between the options.

5. The shower attachment according to claim 3, wherein at least one of the actuating element and the changeover device is designed such that the actuating element returns to a start position after changing between the options.

6. The shower attachment according to claim 1, having two actuating elements, wherein the two actuating elements can be moved independently of one another and wherein each of the two actuating elements switches the changeover device to one of the options in which the water flow emerges at one of the two shower-attachment spray outlets at one of the two different locations on the shower-attachment housing in a respective one of the two different directions.

7. The shower attachment according to claim 1, wherein the changeover device also changes over between two different jet types.

8. The shower attachment according to claim 1, wherein at least one said actuating element comprises a button.

9. The shower attachment according to claim 1, wherein at least one said actuating element is arranged in a region of a front side of the shower-attachment housing, facing a user of the shower attachment.

10. The shower attachment according to claim 1, wherein the joint comprises a ball joint.

11. The shower attachment according to claim 5, wherein said at least one of said actuating element and said changeover device, returns to the start position after a time delay.

12. A shower attachment, comprising:

a shower-attachment housing which can be adjusted in direction on a joint, a changeover device for changing over the water flow in the shower-attachment housing between at least two different options, at least one changeover-device actuating element coupled to the changeover device, wherein the changeover-device actuating element is arranged on the shower-attachment housing and is movable with respect to the shower-attachment housing, wherein the changeover-device actuating element has an actuating direction that coincides with movement of the shower-attachment housing in an adjusting direction on the joint, wherein the changeover device is operated by the changeover-device actuating element to change over the water flow between two shower-attachment spray outlets from the shower-attachment housing, and wherein the two shower-attachment spray outlets are at two different locations on the shower-attachment housing, wherein the joint comprises a rotary joint with a fixed axis, and, wherein the shower-attachment housing is adjusted in an up/down direction on the joint, the actuating element is movable up and down, and the two spray outlets are located on an underside and at a front of the shower-attachment housing respectively.

13. The shower attachment according to claim 12, wherein moving the actuating element up changes over to the spray outlet on the underside of the shower-attachment housing, and moving the actuating element down changes over to the spray outlet at the front of the shower-attachment housing.

* * * * *